United States Patent [19]

Tam

[11] 4,100,477

[45] Jul. 11, 1978

[54] FULLY REGULATED TEMPERATURE COMPENSATED VOLTAGE REGULATOR

[75] Inventor: Richard K. Tam, Poway, Calif.

[73] Assignee: Burroughs Corporation, Detroit, Mich.

[21] Appl. No.: 745,660

[22] Filed: Nov. 29, 1976

[51] Int. Cl.[2] ..... G05F 5/00

[52] U.S. Cl. ..... 323/19; 323/1; 323/8

[58] Field of Search ..... 323/1, 4, 8, 16, 19, 323/22 T, 68

[56] References Cited

U.S. PATENT DOCUMENTS

| | | | |
|---|---|---|---|
| 3,617,859 | 11/1971 | Dobkin et al. | 323/22 T |
| 3,794,861 | 2/1974 | Bernacchi | 323/19 X |
| 3,893,018 | 7/1975 | Marley | 323/22 T |
| 3,908,162 | 9/1975 | Marley et al. | 323/19 |
| 3,970,876 | 7/1976 | Allen et al. | 323/22 T |
| 4,063,120 | 12/1977 | Idei | 323/4 X |

OTHER PUBLICATIONS

Widlar, "New Developments in IC Voltage Regulators", IEEE Journal of Solid-State Circuits, vol. SC-6, No. I, Feb. 1971, pp. 2-7, 323-19.

*Primary Examiner*—A. D. Pellinen

*Attorney, Agent, or Firm*—Joseph R. Dwyer; Mervyn L. Young; Kevin R. Peterson

[57] ABSTRACT

For coupling to a high speed logic device, a monolithic IC regulator is provided which is fully compensated for temperature and for variations in supply voltage. The temperature compensation is accomplished by the proper matching of resistances and current densities in transistor-diode circuitry and the compensation for variations in voltage supply is accomplished by coupling a feedback amplifier section to the regulator, the resistances and diodes of which are carefully matched to the resistances of the regulator so that the feedback amplifier section, being dependent only on such matching, is responsive over large fluctuations of supply current. The feedback amplifier section is also provided with a circuitry which slightly imbalances the amplifier section relative to the regulator so that current will flow through the shunt transistor of the regulator and by further matching the current density of the shunt transistor of the regulator with the current density of a component of the current mode logic device, the desirable characteristics for high speed digital logic functions are accomplished.

9 Claims, 1 Drawing Figure

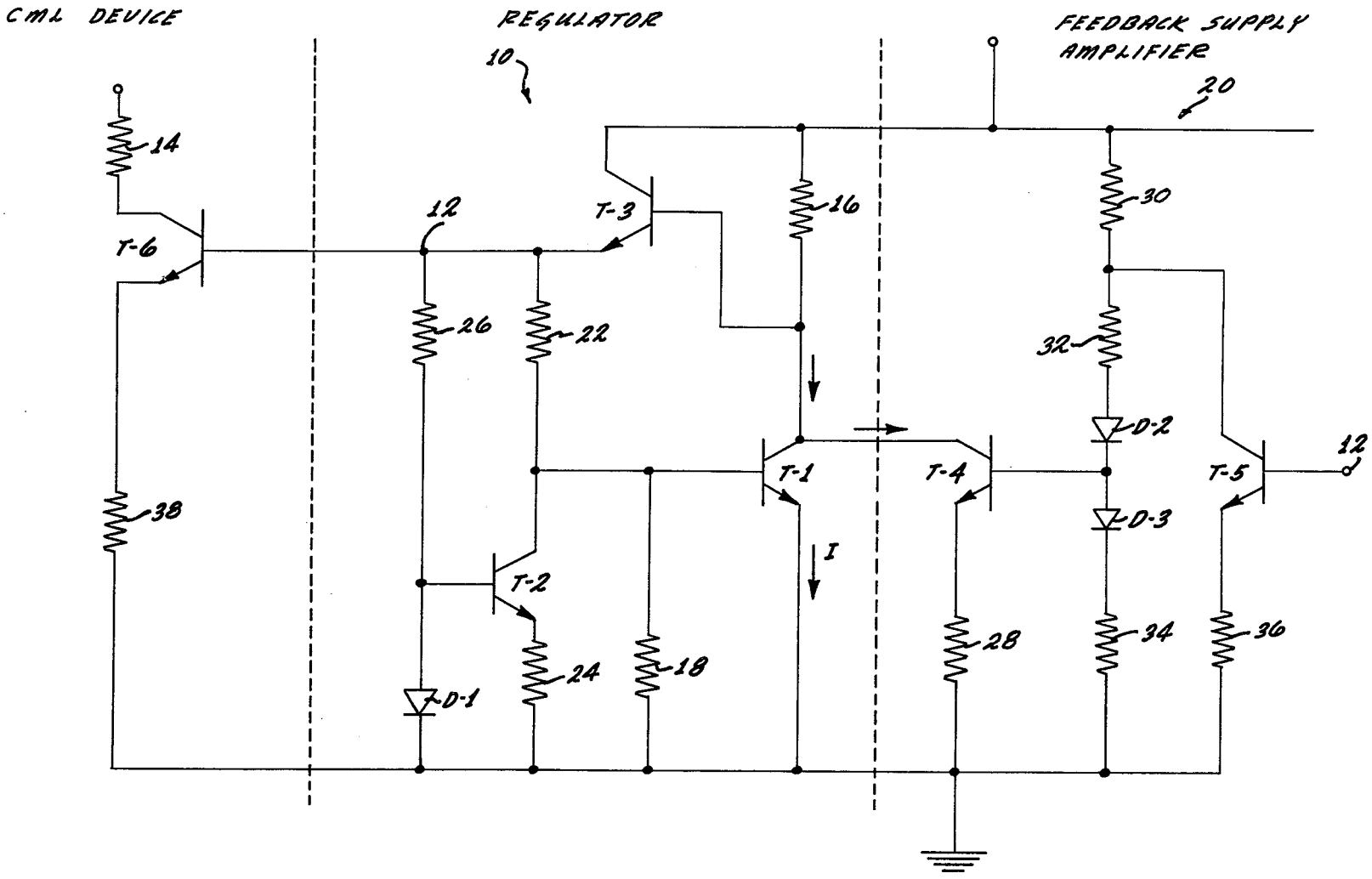
FEEDBACK SUPPLY AMPLIFIER
20
REGULATOR
10
CML DEVICE
12
14
16
18
20
22
24
26
28
30
32
34
36
38
T-1
T-2
T-3
T-4
T-5
T-6
D-1
D-2
D-3
I

FULLY REGULATED TEMPERATURE COMPENSATED VOLTAGE REGULATOR

BACKGROUND OF THE INVENTION

This invention relates in general to voltage regulators in integrated circuit (IC) technology and, in particular, to an IC regulator which is highly advantageous in supplying a constant current source to a current mode logic device used in high speed digital logic systems.

IC voltage regulators capable of providing a zero temperature coefficient regulated output voltage have already been developed. Such regulators have also been developed to supply a constant output voltage for logic circuits within a limited range of variations in the supply voltage. One manner of providing the constant output voltage in such regulators is to use a PNP transistor to provide the constant current in the shunt feedback transistor of the regulator. However, the disadvantage in such a system is the dependency on the absolute characteristics of the PNP transistor, which limited the voltage supply variation range because of the current limitations on the vertical PNP. In addition, the excess phase shift induced by the slow response of the PNP transistor imposed the use of a large rolloff capacitor in the regulator which became impractical in IC circuit applications and sometimes made the regulator oscillation prone.

It is therefore an object of this invention to provide an IC regulator which is fully temperature and supply voltage compensated so as to be useful in high speed digital logic, namely, a current mode logic environment.

Another object of this invention is to provide an IC regulator which is fully temperature and supply voltage compensated so as to be responsive to a wide range of variations in supply voltage and to eliminate any excess phase shift thus making the regulator less prone to oscillation.

SUMMARY OF THE INVENTION

The foregoing objects of the invention are accomplished by the provision of a supply feedback amplifier, coupled to a voltage regulator whose resistances carefully match the resistances of the regulator so that fluctuation in supply voltage is sensed by the supply feedback section which is dependent only on such matching. This matching provides matching current flow in said regulator and feedback corresponding to variations in current so that current flow through the shunt transistor of said regulator is constant. The feedback amplifier section is also provided with a means for precisely imbalancing the feedback circuitry so that current will flow through the shunt transistor of the regulator at all times. Further, by matching the current density of the shunt transistor in the regulator with the current density of the input transistor in the current mode logic device, to which the regulator is coupled, the desirable characteristics for the operation of such high speed, digital logic devices are accomplished.

BRIEF DESCRIPTION OF THE DRAWING

The sole FIGURE of the accompanying drawing illustrates the preferred embodiment of the invention shown coupled to the input transistor of the current mode logic circuit.

DESCRIPTION OF THE PREFERRED EMBODIMENT

In the single FIGURE, all the circuit elements and their connections are deposited on a chip, to form an IC, it being understood that the output voltage therefrom is supplied to an external circuit such as a current mode logic device, but the regulator circuit can be on the same semiconductor wafer as the logic device.

In the drawing, the regulator circuit 10 is provided with a feedback supply amplifier circuit 20 and is coupled to a current mode logic device (CML) at junction 12. The purpose of this regulator and its feedback supply amplifier is to maintain the voltage drop across the resistor 14 in the CML gate constant for the proper operation of this device and, to do this, the regulator 10 is both temperature compensated and voltage supply fluctuation compensated so that the current I will remain constant.

The regulator circuit 10 includes 3 NPN transistors, T-1, T-2 and T-3. Shunt transistor T-1, the current I of which is to remain constant, has its emitter connected to a reference voltage terminal, such as ground, its collector connected to a suitable source of $+Vcc$ through a resistor 16. The base of shunt transistor T-1 is connected to ground through resistor 18 and to the collector of transistor T-2 and common to one end of a resistor 22.

The emitter of transistor T-2 is connected to ground through a resistor 24 and its base is connected to one end of a resistor 26 and to ground through a diode D-1. The other ends of resistors 22 and 26 are connected in common in junction 12 and to the emitter of transistor T-3 whose collector is connected to $+Vcc$ and whose base is connected commonly with the collector of T-1 and the same end of resistor 16. The other end of resistor 16 is connected to $+Vcc$.

The feedback supply amplifier portion 20 of the circuit includes a transistor T-4, whose collector is connected to the collector of T-1 and to $+Vcc$ through resistor 16. The emitter of transistor T-4 is connected to ground through resistor 28 and its base is connected between two diodes D-2 and D-3; D-2 being connected to $+Vcc$ in series with a pair of resistors 30 and 32 with D-3 being connected to ground through resistor 34. While one end of resistor 30 is connected to $+Vcc$, the other end, common with one end of resistor 32 is connected to the collector of transistor T-5 whose emitter is connected to ground through resistor 36. The base of transistor T-5 is connected to junction 12, the same as resistor 26.

In the current mode logic device, a portion of which is shown herein for purposes of illustrating the function of this regulator, input transistor T-6 (forming part of a current source) has its emitter connected to ground through resistor 38 and its base connected to junction 12 which is in common with one end of resistors 26 and 22 and emitter T-3, while its collector is connected to $+Vcc$ through the aforementioned resistor 14.

Before explaining the operation of the voltage regulator 10 comprising this invention, it should be noted first that the current density of the aforementioned input transistor T-6 is matched to the current density of the shunt transistor T-1 and further that the values of the resistances of resistors 30, 32 and 34 together with the value of the resistances of diodes D-2 and D-3 in the feedback supply amplifier 20 are selected to exactly equal the resistance value of resistor 16 in the regulator.

For output voltage regulation to compensate for changes in temperature, the regulator circuit 10 is essentially a well-known temperature compensated Widlar regulator. For example, any decrease in current through resistor 18 due to an increase in temperature affecting the emitter-base voltage ($V_{BE}$) of shunt transistor, T-1 having a negative temperature coefficient, is offset by a positive temperature coefficient compensation circuit comprising the combination of diode D-1 and transistor T-2 so that the voltage across resistor 24 will increase with temperature. Since the current through resistor 24 and resistor 18 is also going through resistor 22, by proper selection of the values of these resistors and temperatures coefficients of transistors T-1 and T-2, the voltage across resistor 22 connected at one end to junction 12, will have a zero temperature coefficient. Thus, while the current going through resistor 18 may have a tendency to decrease with temperature, it has no effect on the current through transistor T-1. Since the operation of temperature compensated circuits in regulators is well known, no further description is deemed necessary. However, if further information is desired, reference is made to the publication entitled, "New Developments in IC Voltage Regulators" by Robert J. Widlar, IEEE Journal of Solid State Circuits, Vol. SC-6, No. 1, February 1971, FIG. 2 and the accompanying explanation on page 3.

For output voltage regulation to compensate for changes in supply voltage, the regulator 10 is provided with the aforementioned feedback supply amplifier circuit 20. Thus, if $+Vcc$, as for example, becomes more positive, such an increase in voltage would normally result in an increase in current I at the collector of the shunt transistor T-1, but this increase is prevented so that current I remains constant, which also maintains the $V_{BE}$ of transistor T-1 constant.

To accomplish this function, one end of resistor 30 of the feedback supply amplifier circuit is connected to $+Vcc$ so that the aforementioned variation in supply explained, by way of example, as an increase in voltage will also be sensed through the series connected resistors 30, 32 and 34 and diodes D-2 and D-3, resulting in an increase in voltage at the base of transistor T-4 with a further result that its collector will draw off a corresponding amount of current from the collector of transistor T-1 so that current I remains constant. The values of resistors 30, 32 and 34 together with the values of the resistances of D-2 and D-3 in this amplifier circuit are selected to be exactly equal to the value of the resistor 16 so that the two circuits formed thereby are in balance.

It should be realized, however, that with the two circuits thus in balance, as they are designed to be, normally no current would flow through the shunt transistor T-1 since it is balanced out by the feedback amplifier circuit. In order to overcome this and to throw the circuitry slightly off balance, so that the collector current I will always flow, the collector of transistor T-5 is connected to one end of the resistor 30, opposite the latter's connection to $+Vcc$ with its emitter connected to ground, through resistor 36. The purpose of this circuit is to subtract slightly from the aforesaid match of resistances, i.e., resistor 30, 32 and 34 and diodes D-2 and D-3, matching the resistance values of resistor 16 and transistor T-1.

Having thus explained the operation of the feedback amplifier supply circuit, 20, it is again pointed out that the main function of this feedback amplifier circuit is to maintain the current I through shunt transistor T-1 constant, so that the voltage ($V_{BE}$) across this transistor will remain constant over variations in supply voltage. As a result, since the current density of transistor T-1 is matched to the current density of the input transistor T-6 of the CML gate, with current I held constant, the voltage across resistor 38 will be exactly equal to the voltage across resistor 22. The voltage at junction 12 equals the $V_{BE}$ of transistor T-1 plus the voltage across resistor 22, so the $V_{BE}$ of transistor T-1 is subtracting the $V_{BE}$ of transistor T-6. Because transistor T-1 is at constant current, transistor T-6, being matched to transistor T-1, the voltage across resistance 38 is the same as the voltage across resistor 22. Therefore, the voltage across resistor 14 remains constant over temperature and supply.

Finally, as to transistor T-3, this transistor is a buffer transistor inserted between junction 12 and resistor 16 so that the transistor T-3 is a base current sensing device with high Beta so as to provide high impedance between resistor 16 and junction 12.

What is claimed is:

1. A voltage regulator comprising:

means providing a reference voltage and a positive supply voltage, circuit means including first and second NPN transistor means connected between said positive supply and said reference voltage and with the base of the first transistor being connected to the collector of the second transistor means so as to be insensitive to changes in temperature, a feedback supply amplifier circuit means between said positive supply voltage and said reference voltage and connected to said first transistor means whereby the current through said first transistor means is maintained constant, over variation in positive supply voltage, said feedback supply amplifier including third NPN transistor means and circuit means, the collector of said third transistor means being connected to the collector of said first transistor means, said feedback supply amplifier further including a first, second and third resistance means and a pair of diode means connected in series between said positive supply voltage and said reference voltage with said base of said third transistor means being connected between said pairs of diode means.

2. The voltage regulator as claimed in claim 2 wherein said regulator circuit includes a first resistance means and wherein the resistance value of said first, second and third resistance means, together with the resistance value of said pair of diode means equals the value of said first resistance means of said regulator.

3. The voltage regulator as claimed in claim 2 wherein means are provided for slightly imbalancing the values of said feedback supply amplifier resistance together with the value of the resistance of said diode means with respect to the value of the first resistance means of said regulator and said first transistor means in said regulator so that current will always flow through said first transistor means.

4. The voltage regulator as claimed in claim 3 wherein said imbalancing means comprises an NPN transistor whose collector is connected between said first and second resistance means of said feedback supply amplifier and whose emitter is connected to said reference voltage through a fourth resistance means.

5. The voltage regulator as claimed in claim 4 wherein the output of said regulator is connected to an input NPN transistor means and wherein the current density of the input NPN transistor means matches the current density of said one of said first and second transistor means of said regulator.

6. A voltage regulator circuit having first and second voltage input terminals for connection across an unregulated direct current voltage source including, in combination:

first, second, and third NPN transistors, each having base emitter and collector electrodes, circuit means connecting the emitter electrode of said first transistor means to ground and its collector electrode to said voltage source through a first resistor means and further connecting its base electrode to the collector electrode of said second transistor and to the emitter electrode of said third transistor through a second resistance means and further connecting its base electrode to ground through a third resistance means, circuit means for connecting the emitter electrode of said second transistor means to ground through a fourth resistance means and its base electrode to around through a first diode means and in common with a fifth resistance means, said fifth resistance means being connected to an output node and to one end of said second resistance means and to the emitter electrode of said third transistor means, circuit means connecting the base electrode of said third transistor means to said first resistance means to the collector of said first transistor means and further connecting its collector electrode to said voltage supply means, the temperature coefficients of said first transistor means being balanced by the temperature coefficients of said second transistor and said first doide means, a feedback supply amplifier circuit including a fourth transistor having base, emitter and collector electrodes, circuit means connecting the collector electrode of said fourth transistor to the collector electrode of said first transistor and its emitter electrode to ground through a sixth resistor, seventh, eighth and ninth resistances in series with a pair of diode means connected between said voltage supply and ground, and circuit means connecting the base electrode of said fourth transistor between said pair of diode means.

7. The voltage regulator circuit as claimed in claim 6 wherein said seventh, eighth and ninth resistor means plus said pairs of diode means equals said first resistance means in resistance value.

8. The voltage regulator circuit as claimed in claim 7 wherein means are connected to said feedback amplifier supply circuit between said seventh and eighth resistance means and ground to imbalance the equal resistance values.

9. The voltage regulator as claimed in claim 8 wherein said output mode is connected to an input NPN transistor means of a utilization device and wherein the current density of said input transistor means equals the current density of said first transistor.

* * * * *